US007156338B2

(12) United States Patent
Schartner

(10) Patent No.: US 7,156,338 B2
(45) Date of Patent: Jan. 2, 2007

(54) BLIND CORD RETRACTOR

(76) Inventor: Elena Schartner, 71 Broad Brook Rd., Bedford Hills, NY (US) 10507

( * ) Notice: Subject to any disclaimer, the term of this patent is extended or adjusted under 35 U.S.C. 154(b) by 0 days.

(21) Appl. No.: 10/851,941

(22) Filed: May 20, 2004

(65) Prior Publication Data

US 2004/0256063 A1 Dec. 23, 2004

Related U.S. Application Data

(60) Provisional application No. 60/477,307, filed on Jun. 9, 2003.

(51) Int. Cl.
*B65H 75/48* (2006.01)
*B65H 75/38* (2006.01)

(52) U.S. Cl. ..... 242/378.4; 242/404; 160/178.1 R

(58) Field of Classification Search ..... 242/378.4, 242/398, 404, 404.1, 404.2, 404.3; 160/178.1 R
See application file for complete search history.

(56) References Cited

U.S. PATENT DOCUMENTS 2,470,250 A * 5/1949 Kienle ..... 225/20
3,046,663 A * 7/1962 Romero ..... 33/354
4,200,249 A * 4/1980 Synstelien et al. ..... 242/396.5
4,909,298 A * 3/1990 Langhart et al. ..... 160/178.1 R
5,212,875 A * 5/1993 Corso ..... 33/414
5,279,473 A * 1/1994 Rozon ..... 242/377
5,762,281 A 6/1998 Foley
5,791,580 A 8/1998 Anderson et al. ..... 242/378.4
5,918,658 A 7/1999 Schartner

OTHER PUBLICATIONS

International Search Report dated Jan. 3, 2006.

* cited by examiner

*Primary Examiner*—Kathy Matecki
*Assistant Examiner*—Sang Kim
(74) *Attorney, Agent, or Firm*—Ostrolenk, Faber, Gerb & Soffen, LLP

(57) ABSTRACT

A cord retractor device provides multiple retracting mechanisms for independently retracting cords in each of the retracting mechanisms while operating the mechanisms in unison. The retracting mechanisms may be ganged together to form a multiple cord retraction mechanism. The retracting mechanisms may be ganged through the use of magnets, adhesives, screws or other suitable coupling agents. The cord retractor mechanism may be provided to permit the insertion of a cord externally in a retrofit option. The retractor mechanism housings may be shaped to depend upon where each mechanism is ganged together, such as in an outer or middle configuration. The ganged cord retractors contributes to preventing cord entanglement while increasing the safety of the cords in a mini blind application.

6 Claims, 10 Drawing Sheets

BLIND CORD RETRACTOR

RELATED APPLICATION

The present application is based on and claims benefit of U.S. Provisional Application No. 60/477,307, filed Jun. 9, 2003, entitled Blind Cord Retractor, to which a claim of priority is hereby made.

BACKGROUND OF THE INVENTION

1. Field of the Invention

The present invention relates to cord retraction devices and more particularly pertains to a new retractable blind pull for automatically retracting a cord after use.

2. Description of the Prior Art

The use of cord retraction devices is known in the prior art. For example, U.S. Pat. No. 5,279,473 to Rozon; U.S. Pat. No. 4,271,893 to McCluskey; U.S. Pat. No. Des. 353,503 to Belue; U.S. Pat. No. 4,909,298 to Langhart et al.; U.S. Pat. No. 4,802,638 to Burger et al.; and U.S. Pat. No. 4,466,581 to Hill all disclose cord retraction devices.

The device disclosed in U.S. Pat. No. 5,918,658 to Schartner includes a cylindrical housing having a front face, a back face and a cylindrical side wall therebetween. The cylindrical side wall has an aperture therethrough exposing a hollow interior. The aperture receives a free end of a mini-blind cord therein. A spool is rotatably disposed within the hollow interior of the cylindrical housing between the front and back face thereof. The spool includes a forward flange, an intermediate flange and a back flange. A space between the forward flange and the intermediate flange is disposed below the aperture in the cylindrical side wall of the cylindrical housing with the mini-blind cord wrapping around the spool between the forward flange and the intermediate flange. A coil spring is wrapped around the spool between the intermediate flange and the back flange for rotation of the spool thereby retracting the mini-blind cord therearound. A lock button is slidably received through the front face of the cylindrical housing and the spool for selectively engaging the spool.

The above cord retractors have several drawbacks for retracting a number of cords individually and without jamming.

U.S. Pat. No. 5,762,281 to Foley shows a cord winder apparatus where one or more cords are attached to a tongue extending from a cord reel housing and are taken up inside the housing when the tongue is released. If the tongue of the device by Foley is prematurely released before cords are attached, the tongue is taken up into the cord reel housing and cannot easily be retrieved without opening the housing, which presents a difficulty for the typical user. It would be desirable to obtain a cord reel device that is easily installed and operated by a general user for taking up multiple cords.

SUMMARY OF THE INVENTION

The present invention provides a new retractable blind pull construction wherein the same can be utilized for automatically retracting a cord after use.

The retractable blind pull apparatus and method provides a housing with a spring and reel for reeling in a cord. Multiple housings are ganged together to permit multiple cords to be retracted at the same time. The shape of the housing permits smooth cord take up for ease of use and to prevent jamming. The size of the housing is dependent on the amount of cord to be taken up.

The retractor operates by taking up cord automatically and rising to a level permitted by the blinds and the blind structure. That is, the retractor hangs on the cord and retracts the cord until blocked by the blind structure, for instance. The retractor is free to move along the cord to take up any slack present.

By ganging the housings together, the retractor takes up cords on a spool in the housing without tangling the cords because the ganged housings act in unison, but each housing takes up cord independently of the other housings. Each housing taking up cord may exert a different amount of tension on the individual cords taken up by the retractor. Any number of housings may be ganged together with magnets or other attaching devices to provide a simple safety solution for cord retraction.

The present invention provides a unique method for attaching cords to a fully wound spring within the cord reel housing so that an attaching device that extends outside the housing to connect with and to take up cord is not necessary. The spool includes an opening through which a cord is passed and retained by reversed bias teeth. The teeth permit the cord to easily pass in one direction, and become caught in the cord when the cord is urged in an opposite direction. By attaching the cord to the spool according to this technique, an attaching device coupled to the spool that must remain outside the housing for attachment to blind cords is not necessary.

According to an advantage of the present invention, the spool is secured in a given position with a button and cog arrangement. A spool locking device that permits insertion of a cord while maintaining the spool in a prewound condition is also contemplated.

Advantageously, the housings are ganged together with magnets. Alternately, or additionally, the housings are attached to a wall or surface with magnets.

Other features and advantages of the present invention will become apparent from the following description of the invention which refers to the accompanying drawings.

DETAILED DESCRIPTION OF THE DRAWINGS

Figure 1:
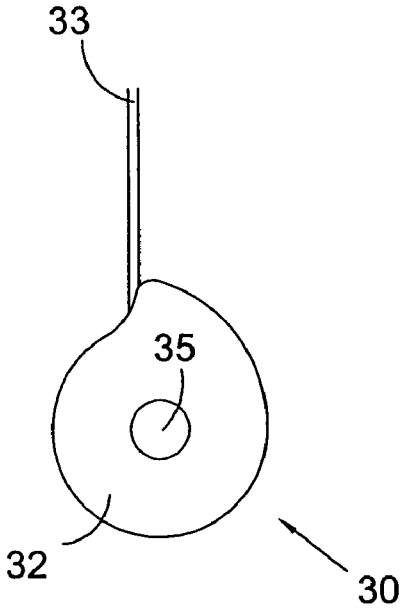
FIG. 1 is a side view of the blind cord retractor according to the present invention.
Figure 2:
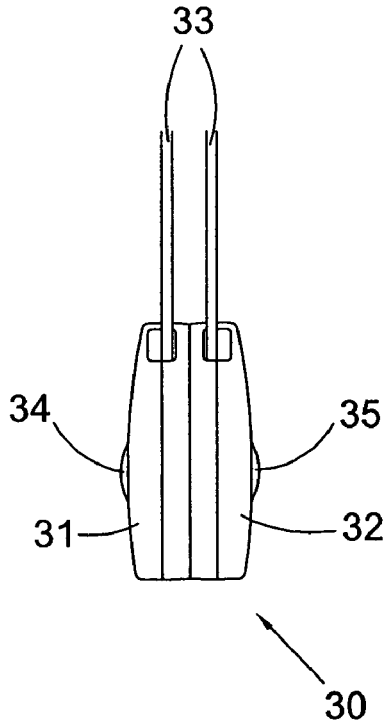
FIG. 2 is a front view of a pair of ganged blind cord retractors according to the present invention.
Figure 3:
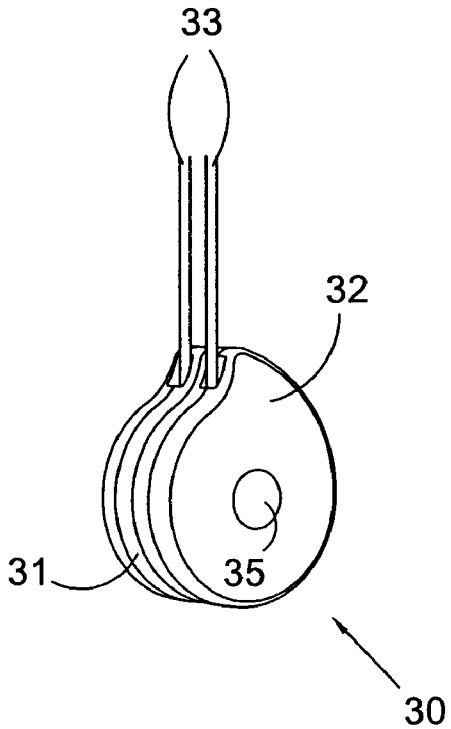
FIG. 3 is a side perspective view of a pair of ganged blind cord retractors according to the present invention.

The blind cord retractor according to the present invention retracts a cord into a housing when tension on the cord is decreased to a certain level. For example, the cord is retracted when the force exerted by a spring in the housing overcomes the tension on the cord. The blind cord retractor is used as a safety device with mini blinds so that excess mini blind cord is taken up within the blind cord retractor so that the mini blind cord is not easily accessible by children, for example.

Referring now to FIGS. 1–5, a blind cord retractor according to the present invention is illustrated as retractor 30. Retractor 30 includes a left and right side retractor mechanism 31 and 32, respectively, each of which is capable of retracting a cord from a mini blind, for example. Retractor mechanisms 31, 32 each house a spring coil that provides a tension on cord 33 to retract cord 33 into retractor mechanisms 31, 32. Retractor mechanisms 31, 32 each have a release button 34, 35, respectively. Release buttons 34, 35 operate to prevent cord retractor 30 from taking up cord into retractor mechanisms 31, 32. As discussed later, release buttons 34, 35 are depressed to release a spool internal to retractor mechanism 31, 32 to permit the spool to rotate with tension from the spring coil to permit retractor 30 to take up excess cord.

Figure 4:
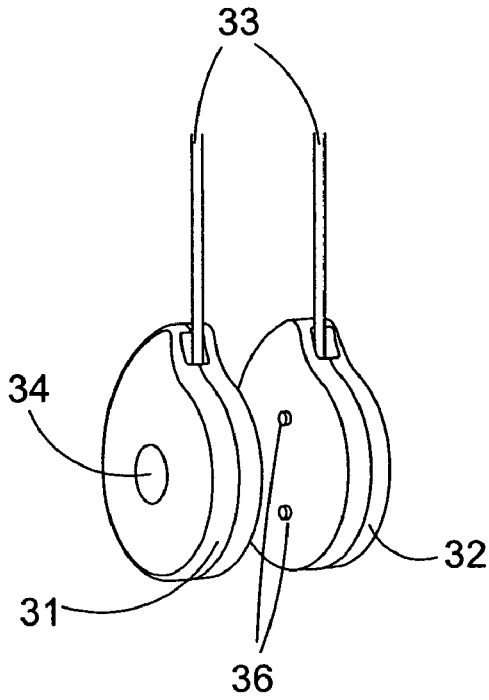
FIG. 4 is a side perspective view of two blind cord retractors separated to show cooperating recesses and detents.
Figure 5:
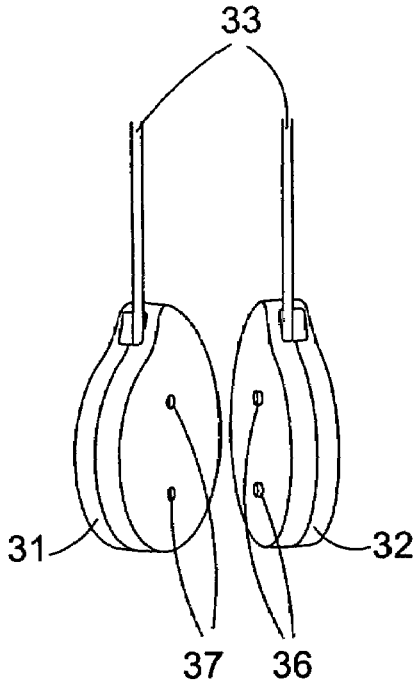
FIG. 5 is another perspective view of blind cord retractors separated to show cooperating recesses and detents.

Retractor mechanisms 31, 32 each have cooperating pairs of recesses and detents in this exemplary embodiment. As shown in FIGS. 4 and 5, right side retractor mechanism 32 has detents 36, while left side retractor mechanism 31 has recesses 37. Detents 36 and recesses 37 cooperate to align left and right side retractor mechanisms 31, 32 when they are coupled together to form cord retractor 30. It should be apparent that detents 36 and recesses 37 may be interchanged between left and right side retractor mechanisms 31, 32, so that either retractor mechanism 31, 32 has detents 36 or recesses 37, or combinations thereof.

Figure 6:
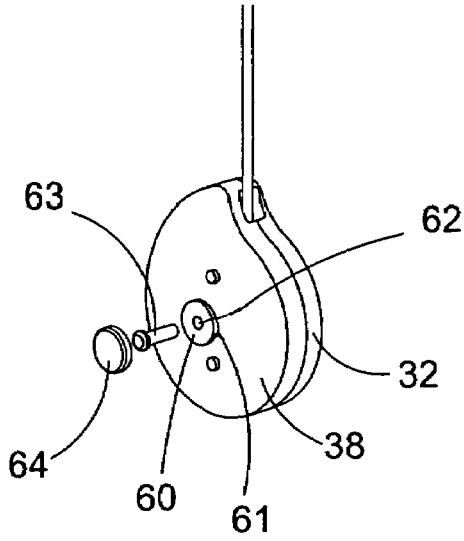
FIG. 6 is an embodiment of a blind cord retractor with a magnet insert.
Figure 7:
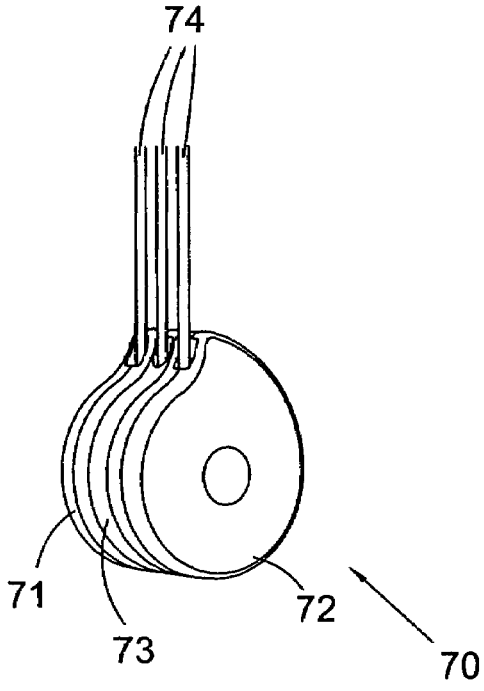
FIG. 7 is a side perspective view of three ganged blind cord retractors.
Figure 8:
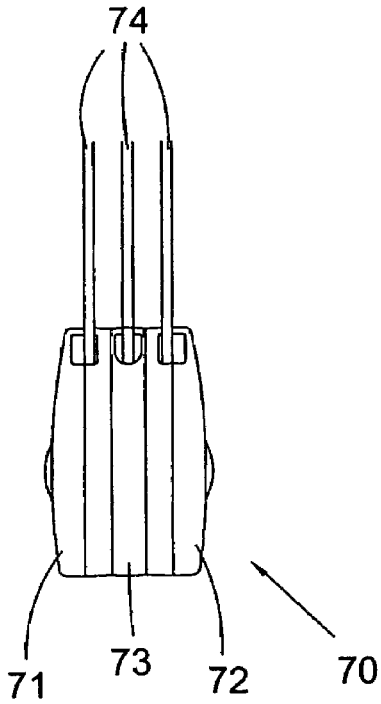
FIG. 8 is a front view of three ganged blind cord retractors.
Figure 9:
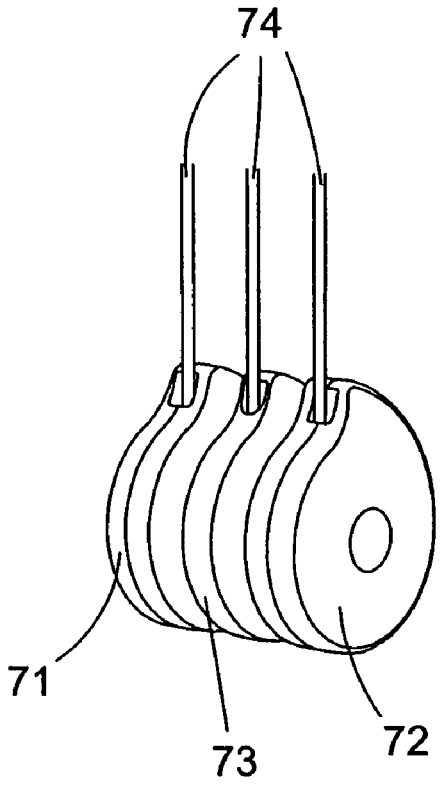
FIG. 9 is a side perspective view of three blind cord retractors separated by a gap.
Figure 10:
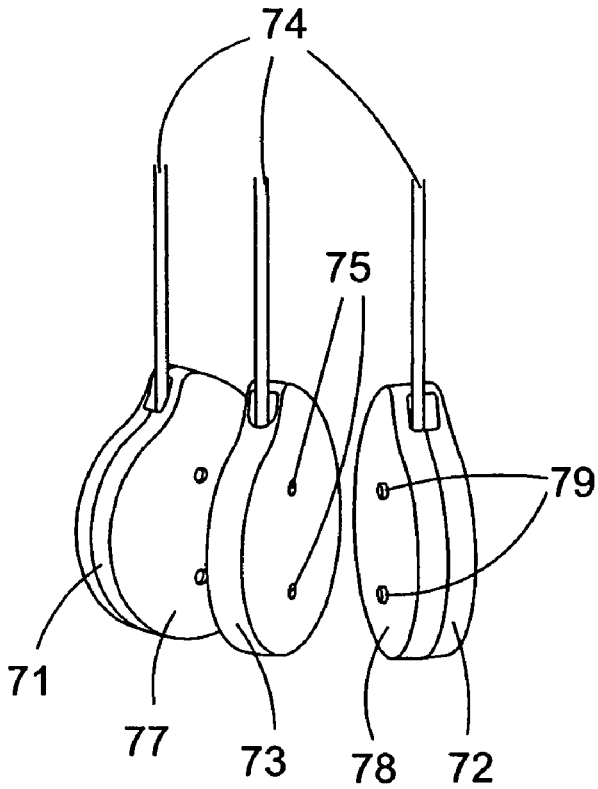
FIG. 10 is a perspective view of three blind cord retractors separated by a gap to show left, middle and right side blind cord retractors.

Preferably, retractor mechanisms 31, 32 are retained together to form cord retractor 30 as a single unit. Any type of retaining means can be used to retain left and right side retractor mechanisms 31, 32 together, including magnets, adhesive, VELCRO (generically referred to as hook and pile or hook and loop fasteners and generically referred to herein as matching patches of hooks and fibers), screws, rivets and the like. Referring to FIG. 6, an exemplary embodiment shows the incorporation of a magnet 60 into right side retractor mechanism 32. Magnet 60 is shaped as a toroid and inserted into a recess 61 sized and shaped to receive magnet 60 below a surface 38 of right side retractor mechanism 32. Recess 61 includes a screw hole 62 to receive a screw 63 to retain magnet 60 in recess 61. A cap 64 is sized to fit over magnet 60 in recess 61 to protect magnet 60 and provide a smooth surface for surface 38. That is, a surface of cap 64 aligns with surface 38 when cap 64 is placed into recess 61 over magnet 60, 50 that right side retractor mechanism 32 presents a smooth surface 38 to permit close coupling with left side retractor mechanism 31. Left side retractor mechanism 31 also has a magnet or ferromagnetic material in an opposing surface to surface 38 so that retractor mechanisms 31, 32 are retained together by the magnetic attracted forces supplied by magnet 60 and its counterpart.

Left and right side retractor mechanisms 31, 32 are shaped differently to provide a similar profile when coupled together and permit access to release buttons 34, 35. Accordingly, when two or more cords 33 are to be retracted into retractor 30, one or more pairs of left and right side retractor mechanisms 31, 32 are used to retract cords 33 in unison. By closing coupling left and right side retractor mechanisms 31, 32 together, left and right side retractor mechanisms 31, 32 serve to stabilize each other with respect to retracting cords 33 as a coordinated unit of retractor 30, even though tension on the cords in mechanisms 31, 32 may be different. For example, if the tension developed within left side retractor mechanism 31 is greater than the tension developed within right side retractor mechanism 32, the mechanisms cooperate to be displaced a similar distance while each potentially taking up a different amount of cord. The close coupling relationship of mechanisms 31, 32 through the cooperation of detents 36 and recesses 37 for example, serves to balance the ability of the separate mechanisms to take up cord. If cord retractor mechanism 31 has greater tension than cord retractor mechanism 32, for example, the close coupling permits left side retractor mechanism 31 to contribute to retractor mechanism 32 retracting additional cord, even if retractor mechanism 32 may have slightly less tension than needed to overcome frictional forces within retractor mechanism 32 to reel in additional cord 33.

Retractor mechanisms 31, 32 may also be separated easily to permit individual manipulation of the respective cords 33. For example, in a number of mini blind applications, individual cords 33 are manipulated to open and close the mini blinds. The manipulation of the cords may result in different length cords 33 to retract into retractor 30. Accordingly, retractor mechanisms 31, 32 may be separated to permit cords 33 to be individually manipulated with ease, and then rejoined to permit the additional and different length cords to be retracted to a same level to contribute to ease of use, aesthetics and safety in the mini blind cord system.

Referring now to FIGS. 7–10, an exemplary embodiment of a three ganged cord retractor 70 is illustrated. Retractor 70 includes left and right side retractors 71, 72, as well as middle retractor 73. Left and right side retractors 71, 72 are the same in construction as left and right side retractor mechanisms 31, 32 shown in FIGS. 1–5. Middle retractor 73 has a different shape than left and right side retractor 71, 72 to be able to cooperate with both of left and right side retractors 71, 72 at the same time. Accordingly, middle retractor 73 has a mating surface for surfaces 77, 78 of left and right side retractors 71, 72, respectively. Middle retractor 73 also includes operating detents or recesses 75, depending upon whether the left or right side retractor 71, 72 is to be mated to the surface of middle retractor 73. For example, if right side retractor 72 has detents 79, then middle retractor 73 has recesses 75. If left side retractor 71 has recesses on surface 77, middle retractor 73 has mating detents to cooperate with the recesses on surface 77.

Middle retractor 73 also has a retaining means to retain a mating relationship with left and right side retractors 71, 72. In an exemplary embodiment, middle retractor 73 includes magnets that cooperate with ferromagnetic material in surfaces 77, 78 of left and right side retractors 71, 72. Left and right side retractors 71, 72 and middle retractor 73 are retained together in this exemplary embodiment through the magnetic attractive forces provided by the magnets and ferromagnetic material. Alternately, or additionally retractor 71, 72 and 73 may be retained together with any type of retaining mechanism, including adhesive, VELCRO (generically referred to as hook and pile or hook and loop fasteners and generically referred to herein as matching patches of hooks and fibers), snap fit couplings, latches or screws, for example. As with double ganged retractor 30, triple ganged retractor 70 may be separated to permit individual manipulation of cords 74, after which retractors 71–73 may be rejoined and retained together to retract an amount of cord individually that permits retractor 70 to operate as a unit, with retractors 71–73 cooperating with each other to stabilize a level reached while each retract spontaneously different amounts of cord 74.

Figure 11:
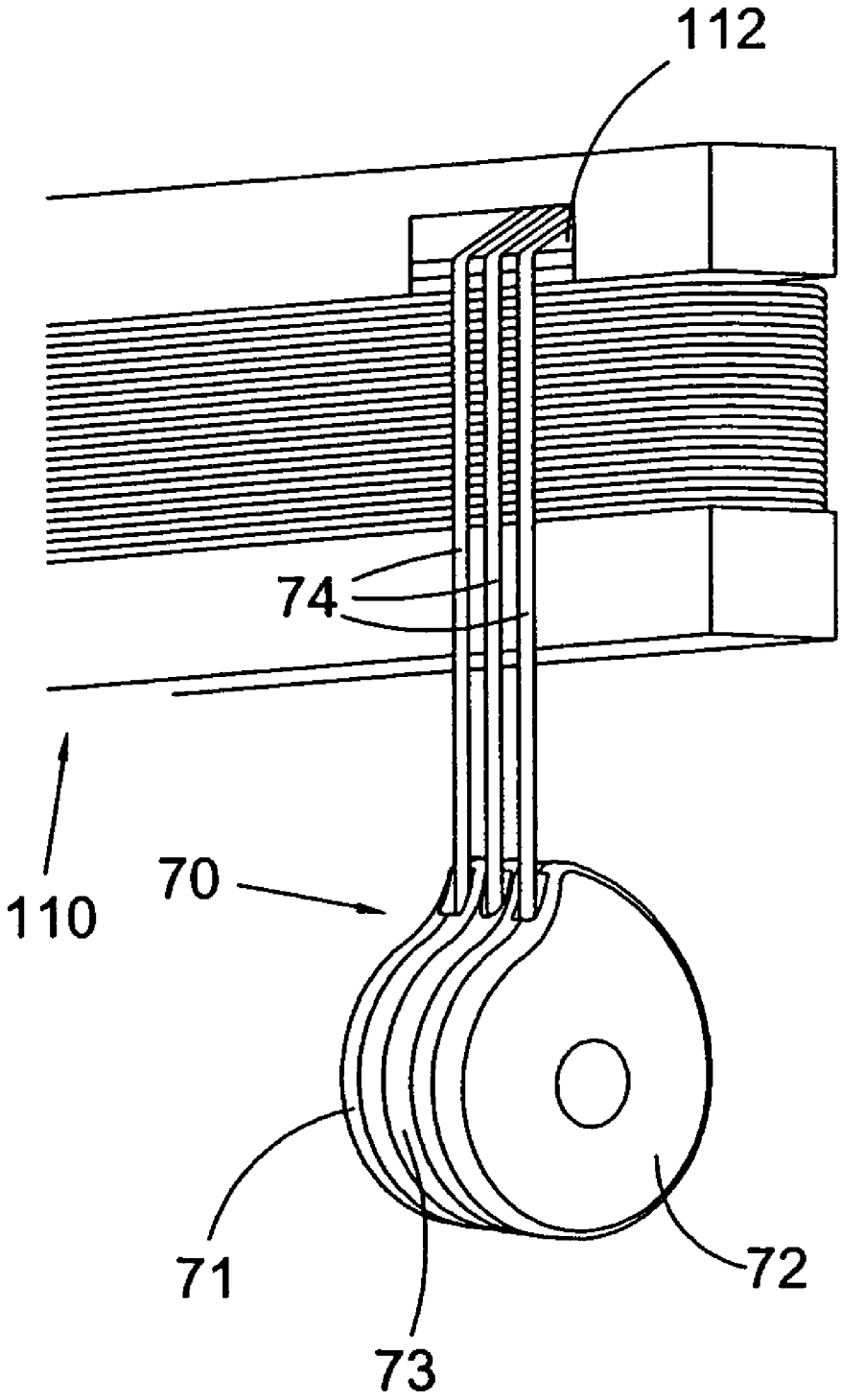
FIG. 11 is a perspective view of a mini blind with an embodiment of the blind cord retractor according to the present invention.

Referring now to FIG. 11, retractor 70 is shown in an operational configuration with mini blinds 110. Preferably, retractor 70 has capacity and enough tension to retract an amount of cord 74 to permit retractor 70 to rise up to cord access opening 112. When retractor 70 retracts enough cord to rise up to opening 112, cord 74 is substantially hidden from view and not accessible, to increase the aesthetic appeal of mini blinds 110, while improving the safety of mini blinds 110.

Figure 12:
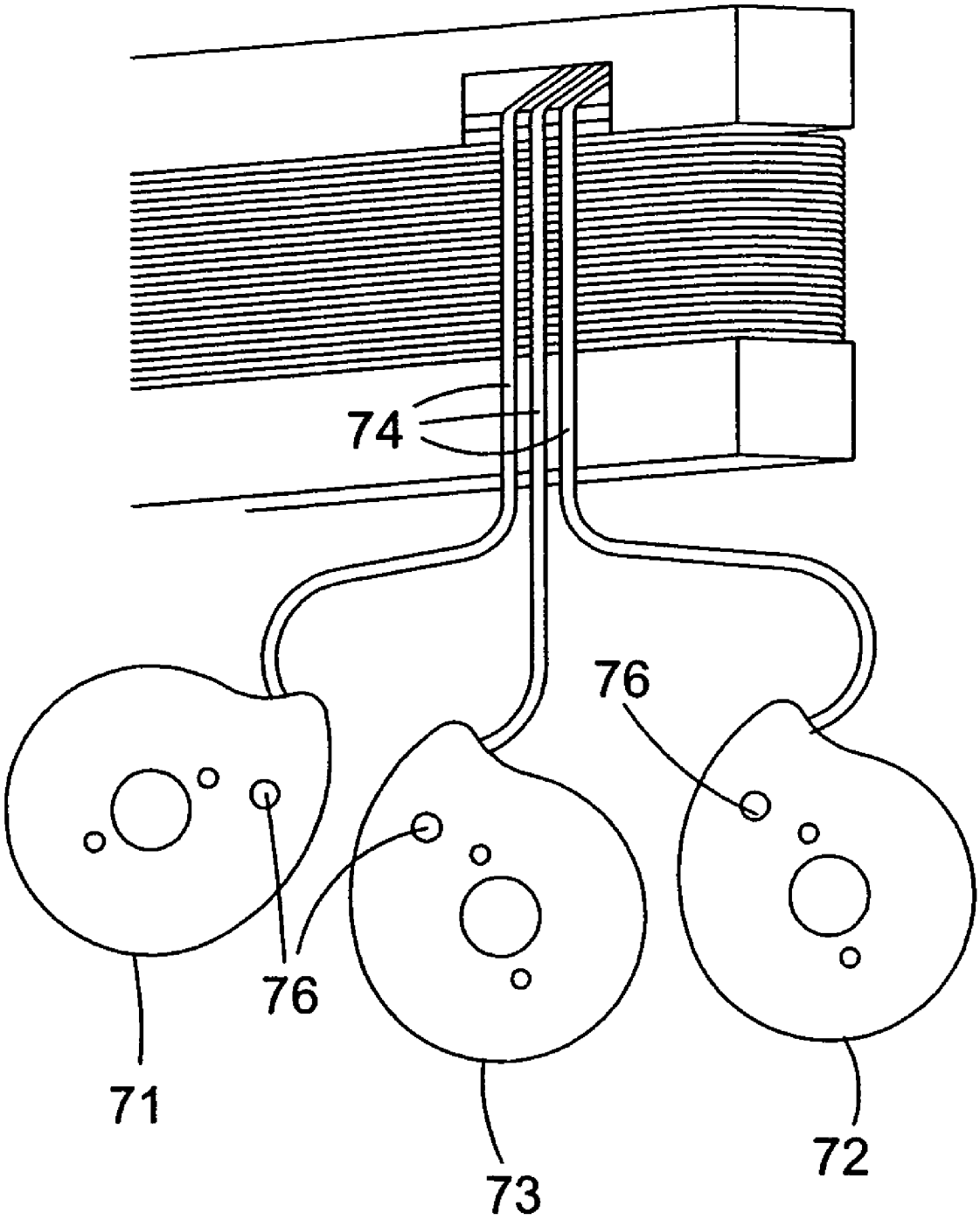
FIG. 12 is a perspective view of a mini blind with an embodiment of the blind cord retractor according to the present invention separated to illustrate retractor features.
Figure 13:
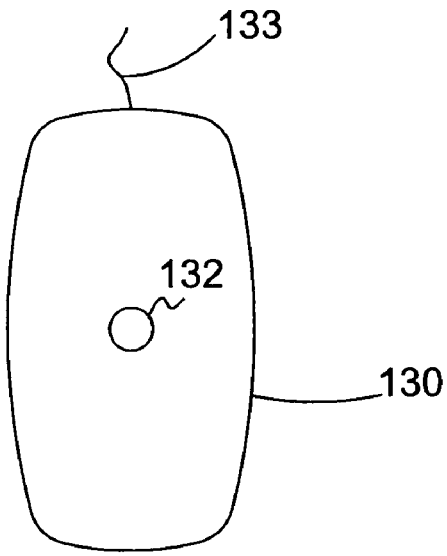
FIG. 13 is a front view of a blind cord retractor according to another embodiment of the present invention.
Figure 14:
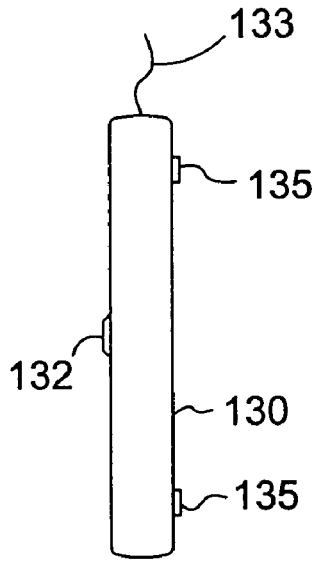
FIG. 14 is a side view of the blind cord retractor of FIG. 13.
Figure 15:
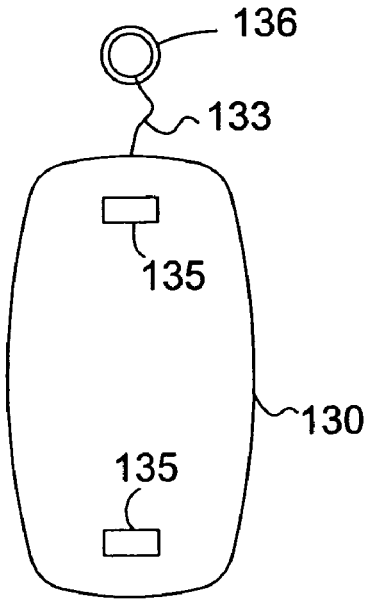
FIG. 15 is a rear view of the blind cord retractor of FIG. 13 with a stop ring connected to the blind cord.
Figure 16:
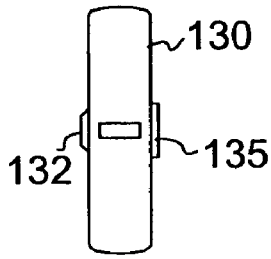
FIG. 16 is a top view of the blind cord retractor of FIG. 13.

Referring now to FIG. 12, left, right and middle retractors 71–73 are illustrated in a separated configuration. By separating retractors 71–73, cords 74 may be manipulated independently. Retractors 71–73 also include magnets 76 embedded in a surface that mates with and cooperates with an adjacent retractor mechanism. Middle retractor 73 has two magnets 76 to cooperate with both left and right side retractors 71, 72. In addition, middle retractor 73 has detents or recesses on mating surfaces to cooperate with receiving detents or recesses on left and right side retractors 71, 72. By ganging together left, middle and right side retractors 71–73, multiple cords may be retracted at the same time independently to permit smooth cord take up without tangling or excess cord not being taken up as may be the case with cord retractors that take up multiple cords on a single spool.

Referring now to FIGS. 13–16, 19, and 26 another embodiment of the present invention is illustrated as cord retractor 130. Retractor 130 includes an internal spool 137 with a spring coil 138 and a release button 132 that operates to arrest the spool and prevent cord 133 from being retracted or played out from retractor 130 when button 132 is depressed. Accordingly, button 132 forms a portion of the locking mechanism to prevent an internal spool 137 of retractor 130 from rotating.

Retractor 130 also includes retaining devices 135 that cooperate with respective retaining devices 135 on opposing retractors 130 to couple the retractors together. Retaining devices 135 may be VELCRO (generically referred to as hook and pile or hook and loop fasteners and generically referred to herein as matching patches of hooks and fibers), magnets, adhesive or other retaining devices that operate to retain pairs of retractors 130 together, and permits their easy separation. The shape of retractor 130 is in the form of an oval to permit the user to grasp retractor 130, or ganged groups of retractors 130, to move retractor 130 from a position near a mini blind, and play out cord 133 so that the user can bring retractor 130 closer and more easily manipulate cord 133. As with the previous embodiments, cords 133 of ganged retractors 130 may be manipulated in unison by unactuating release buttons 132 to release internal spools 137 of retractors 130, so that the user can cause retractors 130 to take up multiple cords 133 at the same time. In a number of mini blind applications, several cords 133, for example, are pulled in unison to raise or lower the mini blind shades. Accordingly, release buttons 132 may be actuated to lock retractors 130 so that cords 133 may be pulled and manipulated by pulling retractors 130 with the internal cord spools locked in position. Prior to attaching cord 133 to a mini blind, or during shipping, a ring 136 may be attached to an end of cord 133 to prevent cord 133 from being accidentally retracted into retractor 130. For example, if button 132 is released inadvertently, cord 133 is retracted into retractor 130, and may not be retrievable without opening retractor 130. Ring 136 prevents the total retraction of cord 133.

Figure 19:
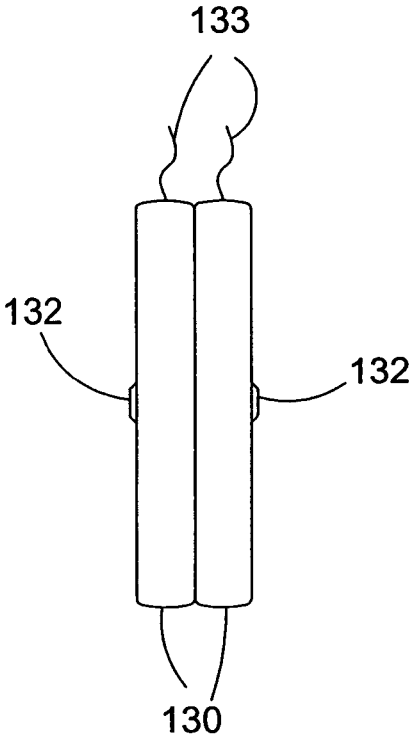
FIG. 19 is a front view of a pair of ganged blind cord retractors according to the embodiment of FIG. 13.

Referring now to FIG. 19, a pair of ganged retractors 130 is illustrated for taking up multiple cords 133. Release buttons 132 may be pressed independently or together to manipulate cords 133 independently or at the same time.

Figure 17:
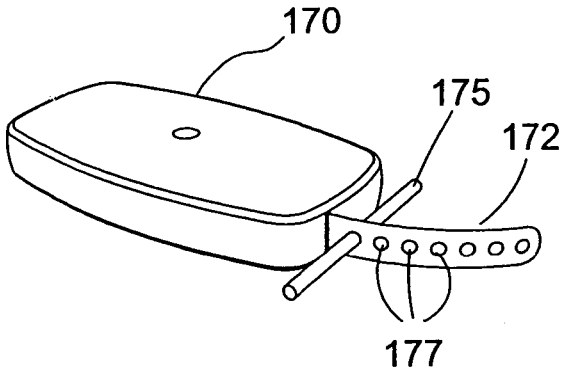
FIG. 17 is a perspective view of a blind cord retractor according to another embodiment of the present invention.
Figure 18:
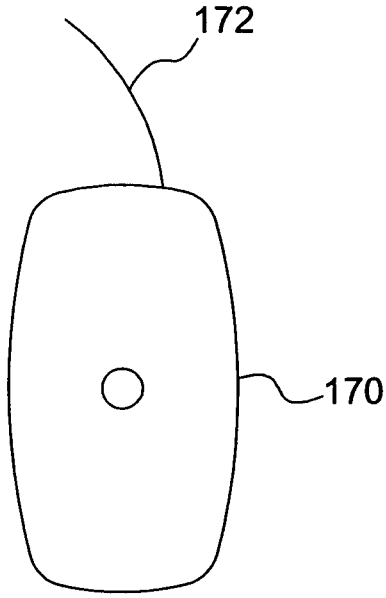
FIG. 18 is a front view of a blind cord retractor according to FIG. 17.

Referring now to FIGS. 17 and 18, another embodiment of the present invention is illustrated as retractor 170. Retractor 170 is designed to be attached to a blind cord to automatically take up the cord in retractor 170. Retractor 170 includes a tongue 172 that is attached to a cord take up spool internal to retractor 170. When tongue 172 extends outside of retractor 170, it is under tension that is near the maximal amount produced from an internal coil spring in retractor 170. That is, when tongue 172 protrudes from retractor 170, the internal spool of retractor 170 is near a limit of rotation in a tensioned state, due to near maximum tension or capacity on the internal coil spring of retractor 170.

A tongue retainer 175 is inserted into one of openings 177 to prevent tongue 172 from being retracted into retractor 170. Accordingly, although tongue 172 is under tension from the internal coil spring of retractor 170, it is prevented from being retracted into retractor 170 by tongue retainer 175. To operate retractor 170, a blind cord is attached to one or more openings, 177, such as by looping the cord through a first opening 177 and then back through another opening 177 where the cord may be knotted to retain the cord in tongue 172. Once the cord is retained by tongue 172, tongue retainer 175 may be removed from opening 177 to permit tongue 172 to be retracted into retractor 170. As tongue 172 is retracted into retractor 170, the attached cord is drawn into retractor 170 and wound onto an internal spool to take up the cord. Because the spool is under tension from the internal coil spring, retractor 170 continues to take up cord until it is blocked, for example, by a mini blind support. Retractor 170 permits the attachment of independent cords to tongue 172, or multiple cords, so that retractor 170 may be used as a retrofit retractor for mini blinds that have no retractor mechanisms.

Figure 20:
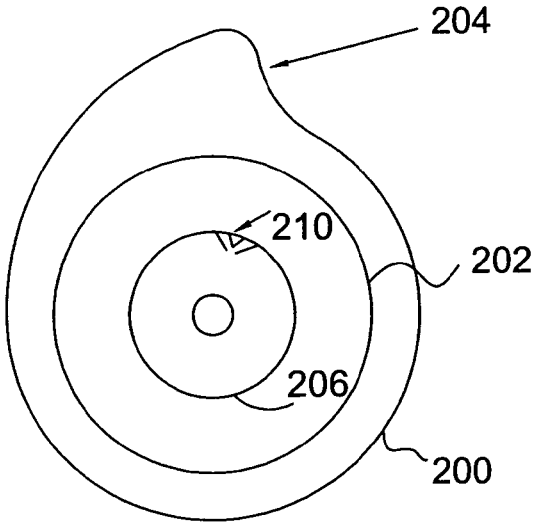
FIG. 20 is a cross-sectional cutaway side view of an embodiment of the blind cord retractor according to the present invention.
Figure 21:
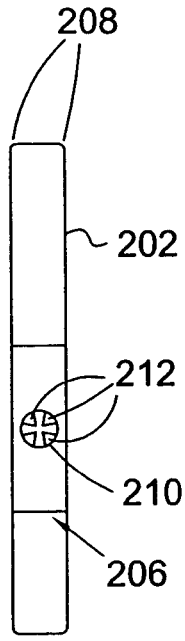
FIG. 21 is a side view of a spool used in the blind cord retractor of FIG. 20.

Referring now to FIGS. 20–21, another embodiment of a cord retractor according to the present invention is illustrated as retractor 200. Retractor 200 includes a spool 202 for taking up cord provided through an opening 204. Spool 202 includes a hub portion 206 on which cord is coiled as spool 202 rotates. Spool 202 also includes side flanges 208 that operate to retain cord on spool 202 as it is coiled when spool 202 rotates.

A cord retainer 210 is located on hub 206 for accepting and retaining an end of a cord passed through opening 204. Accordingly, retractor 200 may be used as a retrofit retractor, when an end of a cord may be inserted into cord retainer 210 when spool 202 is under tension, so that the cord may be coiled up on spool 202 as spool 202 rotates under the tension of a coil spring (not shown).

Cord retainer 210 includes a number of teeth 212 that project toward a center of spool 202. Teeth 212 have pointed edges for protruding into a cord inserted through retainer 210 to retain the cord on spool 202. For example, a cord inserted through opening 204 is projected into cord retainer 210, and easily passes teeth 212 because teeth 212 project in the same direction as that in which the cord is inserted into retainer 210. Once the cord has been inserted into retainer 210, it is prevented from being removed by the pitch of teeth 212 and the pointed edges that protrude into the cord. If the cord is attempted to be removed, teeth 212 project into the cord and flex with the direction of tension on the cord, so that pulling on the cord further enhances the retaining operation of teeth 212 in retainer 210. Alternately, the cord falls between teeth 212, which are separated by triangle shaped gaps, so that the cord is retained in a gap as it is pulled toward a narrowing portion of the gap. The cord may also be retained by teeth 212 with a knot on the end of the cord, which simply abuts between two teeth 212 to prevent removal of the cord. The simple mechanism of retainer 210 permits an end of the cord to be inserted and retained without opening retractor 200. Once the cord is retained in retainer 210, the cord may be coiled on spool 202 so that excess blind cord may be taken up within retractor 200.

Figure 22:
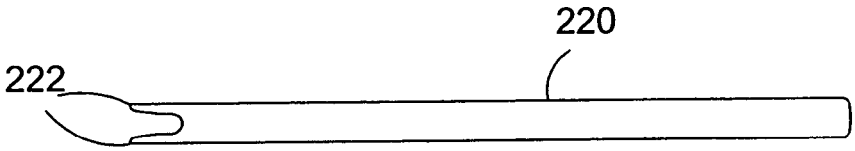
FIG. 22 is a side view of a cord insertion tool according to the present invention.

Referring now to FIG. 22, a cord insertion device 220 is illustrated. Insertion device 220 includes prongs 222 that are used to capture and retain a cord to be inserted into retractor 200 illustrated in FIG. 20. Insertion device 220 is shaped and sized to fit in opening 204 of retractor 200, and place an end of a cord through cord retainer 210. Cord insertion device 220 operates by having an end of the cord inserted between prongs 222, and then being inserted into opening 204 of retractor 200. Insertion device 220 is further inserted into retractor 200 to extend through cord retainer 210 with a cord held between prongs 222. Once an end of the cord held by prongs 222 is inserted through cord retainer 210, insertion device 220 is removed from retractor 200, with the cord being retained by cord retainer 210 such that the cord is removed from prongs 222 of insertion device 220. After insertion device 220 is removed from retractor 200, the cord is retained by cord retainer 210, and the cord may be coiled on spool 202 of retractor 200.

Figure 23:
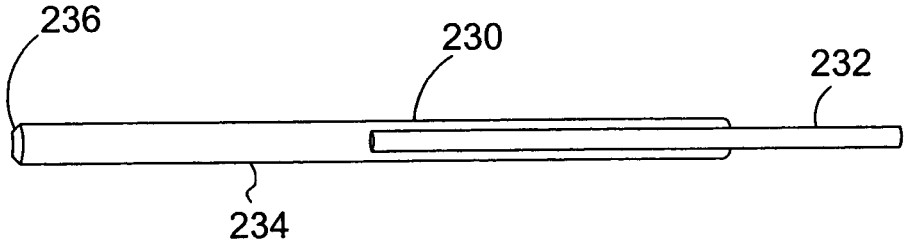
FIG. 23 is side view of another embodiment of an insertion tool according to the present invention.

Turning to FIG. 23, another embodiment of a cord insertion device 230 is illustrated. Cord insertion device 230 includes a plunger 232 that can be moved within a sleeve 234. An end of the cord is bundled within tip 236 for insertion into cord retainer 210. When a cord end is inserted into tip 236 of sleeve 234, insertion device 230 is inserted into retractor 200 so that sleeve 234 protrudes into cord retainer 210. Once sleeve 234 is inserted through cord retainer 210, plunger 232 is advanced through sleeve 234 to push the cord end retained in tip 236 through cord retainer 210. Once the cord is passed through cord retainer 210, insertion device 230 may be removed from retractor 200. Preferably, cord insertion device 230 permits a cord to be passed through sleeve 234 to be retained by tip 236 to have the cord retained in cord retainer 210. In this situation, sleeve 234 is withdrawn from retractor 200 after the cord is retained in cord retainer 210, and may be simply broken off or removed from the cord passing all the way through sleeve 234.

Figure 24:
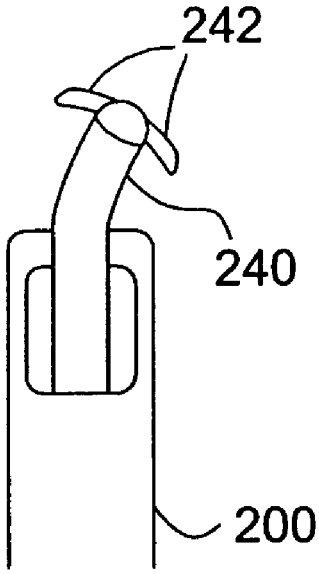
FIG. 24 is a cutaway view of a cord insertion device in a blind cord retractor according to the present invention.

Referring now to FIG. 24, another embodiment of an insertion device is illustrated as insertion device 240. Insertion device 240 may be a flexible tube that extends through cord retainer 210 to permit passage of a cord through insertion device 240 and through cord retainer 210 without obstruction. Once a cord has been passed through insertion device 240 and through cord retainer 210, insertion device 240 is removed from retractor 200, with the cord still retained in cord retainer 210. When insertion device 240 is removed from retractor 200, it is simply snapped off of or removed from the cord passing therethrough to permit the cord retractor to operate as normal. Insertion device 240 includes one or more flaps 242 that prevent cord insertion device 240 from being retracted into retractor 200. At the same time, insertion device 240 serves to lock the internal spool of retractor 200 to prevent movement of the spool during shipment, for example. Once cord insertion device 240 is removed from retractor 200, the internal spool may be actuated to rotate and take up excess cord, for example by pressing an associated release button.

Figure 25:
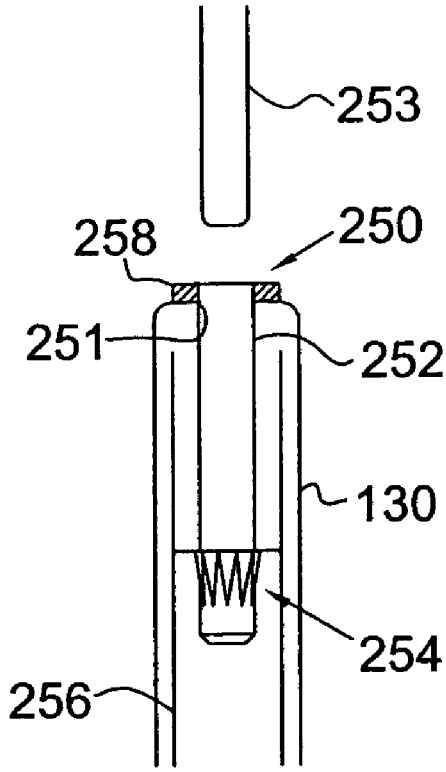
FIG. 25 is a partial cross-sectional view of a blind cord retractor with an embodiment of a cord insertion device according to the present invention.
Figure 26:
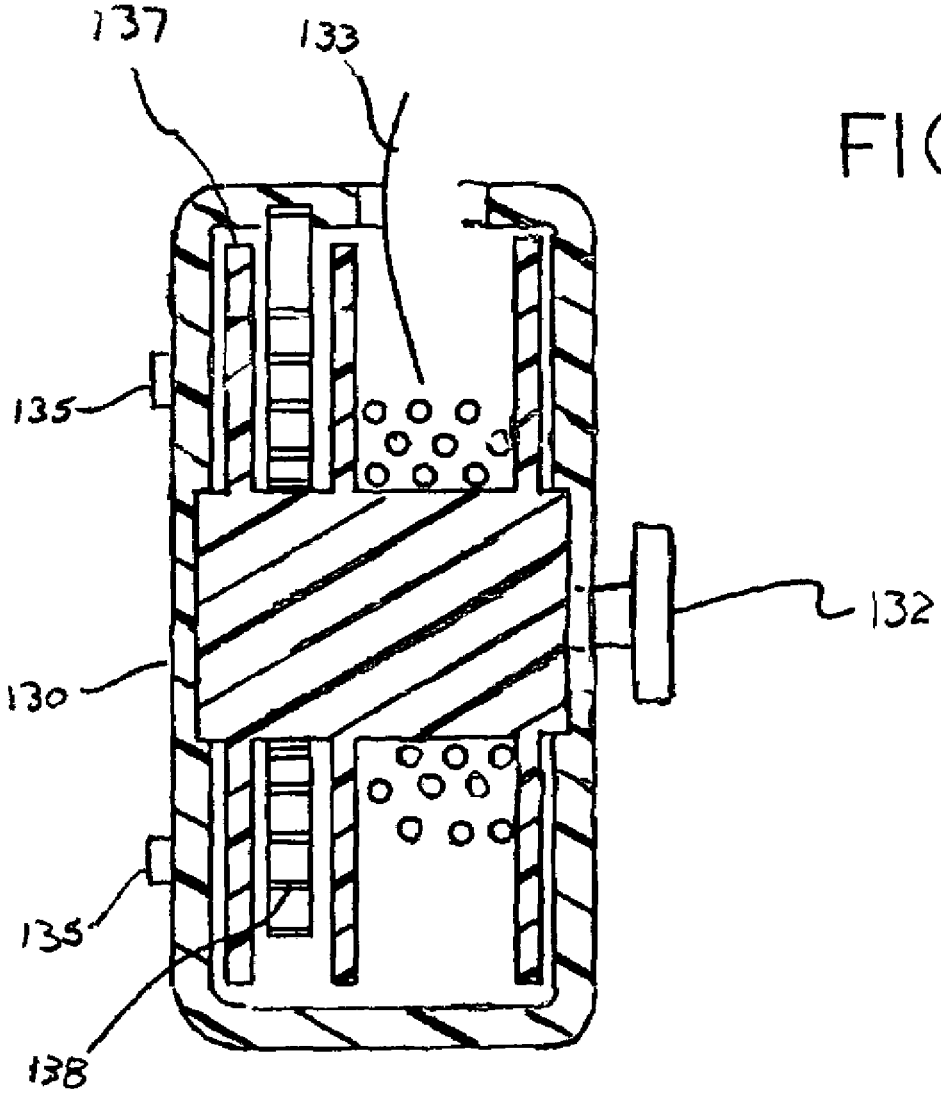
FIG. 26 is an expanded cross-sectional side view of the blind cord retractor of FIG. 13.

Referring now to FIG. 25, another embodiment of a cord insertion device 250 is illustrated. Insertion device 250 includes a tube 252 that extends into retractor 130 and through a cord retainer 254 in a spool 256. Tube 252 extends from outside of retractor 130 into spool 256 to provide a path for insertion of a cord into spool 256. Tube 252 is prevented from traveling further into retractor 130 by a collar 258 that extends beyond an opening 251 in cord retractor 130. That is, collar 258 has a dimension that is greater than the dimension of opening 251 to prevent tube 252 from sliding further into retractor 130. Preferably, retractor 130 is shipped with insertion device 250 already in place, to prevent spool 256 from rotating prior to usage. If spool 256 is permitted to rotate, it may unwind the internal coil spring so that spool 256 must be rewound to provide a tensioning action for inserted cords.

Cord insertion device 250 operates by providing a passage for the insertion of a cord into retractor 130 and through cord retainer 254. A dowel or push rod 253 may be used to insert a cord end through tube 252 to extend through cord retainer 254. Once a cord is inserted into tube 252, insertion device 250 is removed from retractor 130, leaving the inserted cord behind to be retained by cord retainer 254. Once insertion device 250 is removed from retractor 130, the cord is retained by cord retainer 254, and spool 256 is no longer locked by insertion device 250. At this point, retractor 130 is operational to retract the inserted cord and take up any additional cord slack.

Because insertion device 250 surrounds the inserted cord, it may block operation of the cord being retracted into retractor 130, and may be removed. Insertion device 250 may be composed of an easily breakable material such as appropriately formulated resins or plastics so that removal from the cord is a simple matter. Alternately, or additionally, insertion device 250 may include a slit along a length of tube 252 to permit removal of the cord from insertion device 250 without necessarily damaging insertion device 250, for example. According to this alternative, insertion device 250 may be reused on the same or other retractor devices.

As described above, the housing shapes of the various cord retractors may vary depending on how the retractors are ganged together. A three ganged retractor includes a right, middle and left housing that are each shaped differently so that a same profile for the ganged housings is maintained. The cooperative detents and recesses permit the housings to remain in relative respective positions. The housings may be ganged together and retained with magnetic attracted forces, where the magnets are embedded in a wall or surface of the housing, or lodged in a slot or pocket in the casing and housing.

The buttons provided on the outer housings of the retractors arrest the spring and reel mechanism of the retractor which can be freed when the button is depressed, so that a user can manipulate the cords for an appropriate blind level. In an exemplary embodiment, the button includes cogs that cooperate with notches in the spool under spring tension, and thereby arrest movement of the spool. The button may be depressed against the spring tension to free the cogs from the notches to permit the spool to rotate. A number of other arrangements should be apparent, where the spool may be arrested from movement using friction, interlocking parts or teeth, portions of the button or the casing of the retractor device.

The housing of the retractor devices may be decorated with a number of motifs to match associated mini blinds, or according to a consumer's wishes. For example, the retractors may be provided as a retrofit to a set of mini blinds as a decorative item. The housings and other parts of the retractors may be made from any suitable material, including plastics and resins suitable for wear and impact resistance. The housings may be constructed with two shelf pieces attached together with any suitable means, including, for example, screws, adhesive, rivets and the like. The attachment of the housing may retain the spool, spring or other retractor components internally.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A cord retractor device, comprising:

a plurality of cord retractor mechanisms, each being operable to retract a cord and coupled together to act in unison;

a coupling device attached to one of the retractor mechanisms and operable to cooperate with another of the retractor mechanisms to couple the mechanisms together, whereby the plurality of retractor mechanisms operate in unison to independently retract respective cords;

wherein at least one of the retractor mechanisms includes a stopping device for arresting an internal spool of the at least one retractor mechanism when actuated, thereby preventing withdrawal or retraction of the cord.

2. The cord retractor device according to claim 1, wherein the plurality of retractor mechanisms include a pair of retractor mechanisms having cooperating locating parts on respective mechanisms, whereby the pair of mechanisms are oriented with respect to each other when they are coupled together.

3. The cord retractor device according to claim 2, wherein the cooperating parts are recesses and detents, respectively located on retractor mechanisms to be coupled together, whereby the coupled mechanisms are oriented with respect to each other.

4. The cord retractor device according to claim 1, wherein the coupling device is a magnet.

5. The cord retractor device according to claim 1, wherein the coupling device comprises mating patches of hooks and fibers, respectively positioned on retractor mechanisms to permit the retractor mechanisms to be coupled together when the patches of hooks and fibers cooperate.

6. The cord retractor device according to claim 1, wherein the plurality of retractor mechanisms includes at least three retractor mechanisms that can be cooperatively coupled together.

* * * * *